US009517475B2

(12) United States Patent
Kusumoto et al.

(10) Patent No.: US 9,517,475 B2
(45) Date of Patent: Dec. 13, 2016

(54) CENTRIFUGE WITH OVERLAPPING METAL PLATE

(71) Applicant: HITACHI KOKI CO., LTD., Tokyo (JP)

(72) Inventors: Shoji Kusumoto, Ibaraki (JP); Yoshitaka Imoto, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 199 days.

(21) Appl. No.: 14/218,341

(22) Filed: Mar. 18, 2014

(65) Prior Publication Data

US 2014/0296051 A1 Oct. 2, 2014

(30) Foreign Application Priority Data

Mar. 27, 2013 (JP) ..... 2013-067458
Mar. 28, 2013 (JP) ..... 2013-067917

(51) Int. Cl.
*B04B 7/06* (2006.01)
*B04B 7/02* (2006.01)
*B04B 15/02* (2006.01)

(52) U.S. Cl.
CPC . *B04B 7/06* (2013.01); *B04B 7/02* (2013.01); *B04B 15/02* (2013.01)

(58) Field of Classification Search
CPC ..... B04B 7/02; B04B 7/06; B04B 7/12; B04B 15/00; B04B 15/02
USPC ..... 494/12, 13, 14, 81
See application file for complete search history.

(56) References Cited

U.S. PATENT DOCUMENTS 2,631,015 A * 3/1953 Probst ..... B01J 19/02 165/11.1
3,074,584 A * 1/1963 Dobell ..... B21C 37/124 220/586
6,627,136 B2 * 9/2003 Frey, Jr. ..... B65D 90/04 264/269
2014/0128240 A1 * 5/2014 Eigemeier ..... B04B 7/02 494/12

FOREIGN PATENT DOCUMENTS

JP 50-56988 A 5/1975
JP 6-15745 A 1/1994
JP 2001-104827 A 4/2001
JP 2001104827 A * 4/2001
JP 2005-230744 A 9/2005
JP 2005-305400 A 11/2005
JP 2005305400 A * 11/2005
JP 2005-349260 A 12/2005

OTHER PUBLICATIONS

JP 2001104827 Espacenet Machine Translation.*
JP 2005305400 Espacenet Machine Translation.*

* cited by examiner

*Primary Examiner* — Charles Cooley
*Assistant Examiner* — Shuyi S Liu
(74) *Attorney, Agent, or Firm* — Kenealy Vaidya LLP

(57) ABSTRACT

A centrifuge including: a rotor configured to be rotatably driven; a rotor chamber accommodating the rotor therein; and a protector provided at an outer periphery of the rotor chamber, wherein the protector includes at least one metal plate which is wound in an overlapping state.

8 Claims, 8 Drawing Sheets

COMPARATIVE EXAMPLE

CENTRIFUGE WITH OVERLAPPING METAL PLATE

CROSS-REFERENCE TO RELATED APPLICATIONS

This application claims priority from Japanese Patent Application No. 2013-067458 filed on Mar. 27, 2013, and Japanese Patent Application No. 2013-067917 filed on Mar. 28, 2013, the entire contents of which are incorporated herein by reference.

TECHNICAL FIELD

Aspects of the present invention relate to a centrifuge having a rotor which is a high-speed rotational body, more particularly, relate to ensuring the safety thereof.

BACKGROUND

Generally, in a centrifuge, a sample container such as a centrifugal tube or a bottle, which contains a sample (e.g., culture fluid or blood) to be separated, is held by a rotor. The centrifuge serves to separate or purify the sample by rotating the rotor at high speed, by a drive apparatus such as a motor or the like, in a rotor chamber (rotational chamber) sealed by a door to exert a centrifugal force on the sample in the sample container.

The rotor varies in its rotational speed depending on the application thereof. A maximum rotational speed of the rotor is typically in the range from a relatively low speed of approximately thousands of rpm to a high speed of 150,000 rpm. As such, the maximum rotational speed of the rotor used in the generally provided product groups is in a wide range. Further, the various-sized centrifuges from a small centrifuge to a large centrifuge are lined up so that a capacity of the sample capable of being separated at once is in a wide range from a small capacity of several tens of ml to a large capacity of several L.

Since a large centrifugal force is required in order to perform a fast separation of the sample and the large centrifugal force is also applied to the rotor, internal stress is generated in the rotor accordingly (see JP 2005-349260 A). Manufacturers have designed centrifuges with sufficient margins so that the rotor is not broken by the internal stress or the like. However, in the IEC 61010-2-020 standard of the international standard, it is required that a test should be carried out under predetermined conditions, to ensure safety by clearing certain conditions. In this regard, many inventions relating to a protection against breakage of the rotor have been made (for example, see JP S50-56988, JP 2001-104827 A, JP 2005-230744 A, JP 2005-305400 A, JP 2005-349260 A).

For example, as shown in JP 2005-305400 A, the centrifuge includes a rotor chamber in which the rotor rotates, and a cooling pipe is often wound around the rotor chamber (sometimes, the cooling pipe is not wound). In the centrifuge with the cooling pipe being wound, the centrifuge generally has a structure in which a heat insulation layer formed with an insulating material is wound around the cooling pipe, a cylindrical protector is further disposed around the insulation layer, and a box shaped frame is formed at the outermost side. In a related-art centrifuge, a thick protector is used in accordance with a rotational energy, and by making the protector deform or rotate when the rotor is broken, energy is absorbed. Herein, to enable the protector, which is deformed by the broken rotor, to move in the rotational direction of the rotor within the frame and prevent the frame from being deformed according to the protector being deformed, there has been a need to secure a large space in the inner side of the frame in order for the protector to not be in contact with the inner surface of the frame even when the protector is deformed and rotated in the rotational direction by the broken rotor. Meanwhile, since centrifuges such as those used in laboratories or science labs are relatively large among experimental equipments, downsizing thereof has been desired by a user. Especially, since a large centrifuge among the centrifuges becomes larger in the occupied area than a small centrifuge, such desire of downsizing is particularly remarkable.

SUMMARY

The size of the rotor chamber is determined according to the size of the rotor to be used, and the required thickness of the heat insulation layer around the rotor chamber is substantially determined depending on the purposed cooling degree. Accordingly, it is most preferable that the protector is arranged to surround the immediate surroundings of the heat insulation layer in view of the miniaturization thereof, but the selection of the protector has the following limitations. Although a steel pipe which is generally available on the market is used as the thick protector, the steel pipe having a required size cannot easily be obtained because the size of the steel pipe is determined based on the standards. Particularly, as the size of the steel pipe becomes larger, the degree of freedom in the selection of the size of the steel pipe is reduced. In the large centrifuge, since a steel pipe of a large size is required, the selection of the size of the steel pipe is reduced and it is rare for a user to obtain a steel pipe having a required size. Although it may be possible to manufacture the steel pipe having a required size in a custom manner, in this case, a large amount of steel pipes must be mass-produced at once, which is not realistic.

In a case where there is no steel pipe having a required size, one can think of using a steel pipe having a slightly larger size. In this case, however, an unnecessary gap between the protector and the heat insulation layer is created, thereby degrading the miniaturization.

Originally, in a protection system used in a destructive test of the centrifuge, one effective method is that the thick protector is kept to receive the fragments of the broken rotor and the space between the protector and the frame is secured, so that the deformed protector and the frame do not contact with each other and the rotational force is received only by the protector. As described above, however, it is difficult for the large centrifuge to adopt the thick protector, and further, it is difficult to secure the gap between the protector and the frame since the miniaturization in the main body size is required. Under such a situation, to comply with the IEC standards so as to ensure the safety, a new idea different from the related-art protection systems has been required.

Aspects of the present invention have been made in consideration of at least one of the above-described problems. An object of the present invention is to provide a centrifuge capable of reducing the size of an outer appearance thereof and the manufacturing cost thereof by using an inexpensive protector having an appropriate size tailored to the size of a rotor chamber.

Another object of the present invention is to provide a centrifuge capable of reducing its size as compared with related-art, while securing the safety against breakage of a rotor.

According to an aspect of the present invention, there is provided a centrifuge including: a rotor configured to be rotatably driven; a rotor chamber accommodating the rotor therein; and a protector provided at an outer periphery of the rotor chamber, wherein the protector includes at least one metal plate which is wound in an overlapping state.

According to another aspect of the present invention, there is provided a centrifuge including: a rotor configured to be rotatably driven; a rotor chamber accommodating the rotor therein; a protector provided at an outer periphery of the rotor chamber; and a frame surrounding at least an outer periphery of the protector, wherein the protector and the frame are joined to each other at at least one position.

Meanwhile, any combination of the components described above, and transformation of the present invention into methods or systems are also effective as aspects of the present invention.

According to an aspect of the present invention, it is possible to manufacture at low cost a protector of appropriate size which is not generally available on the market as a steel pipe. Accordingly, it is possible to secure the safety based on IEC Standards without enlarging the size of the outer appearance of the centrifuge requiring the miniaturization thereof, particularly a large centrifuge.

According to another aspect of the present invention, it is possible to realize miniaturization as compared with related-art while ensuring the safety against breakage of a rotor.

DETAILED DESCRIPTION

First Embodiment

Figure 1:
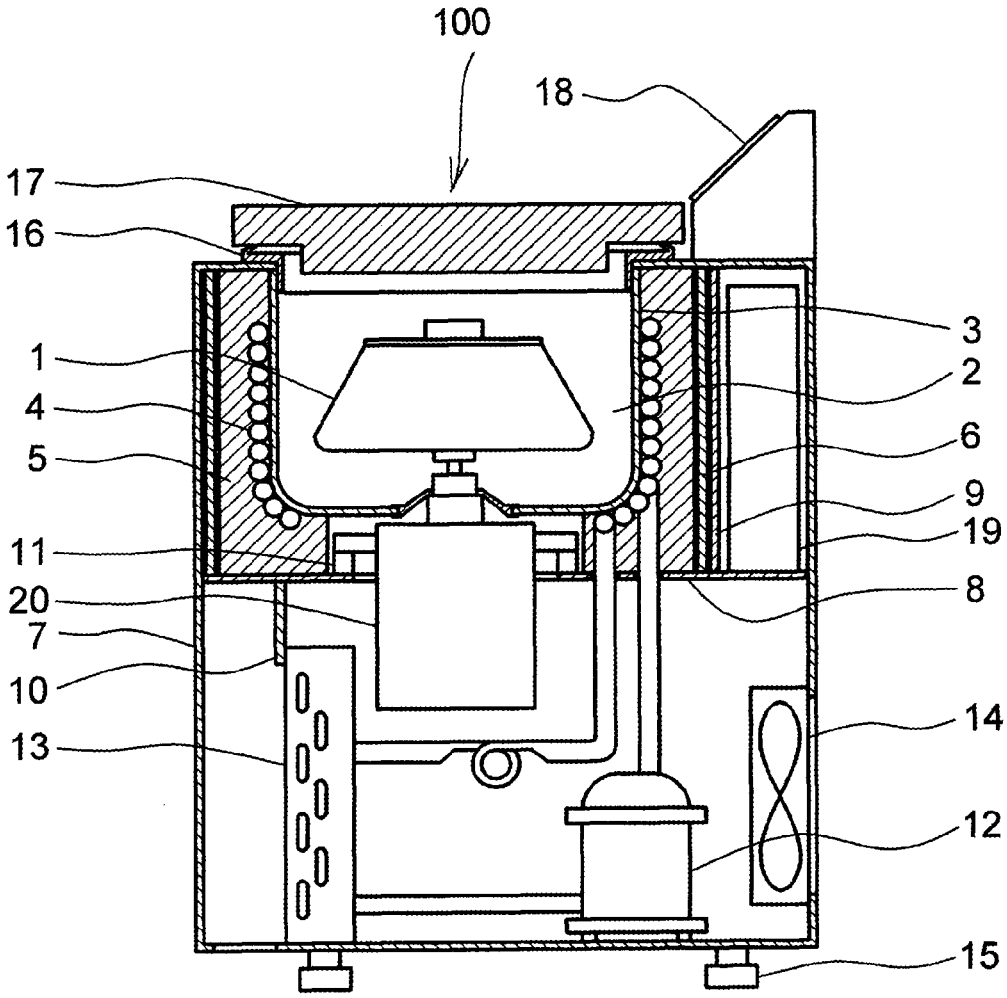
FIG. 1 is a cross-sectional side view of a centrifuge according to a first embodiment of the present invention.

Hereinafter, the preferred embodiments of the invention will be described with reference to the accompanying drawings. The same or equivalent elements, members, and processes shown in the drawings are denoted by the same reference numerals, and redundant description thereon will be omitted appropriately. In addition, embodiments are not intended to limit the invention, but are merely examples. All features and combinations thereof which are described in the embodiments are not necessarily essential to the invention.

FIG. 1 shows a schematic configuration according to a first embodiment of the present invention, and is a cross-sectional side view of a centrifuge (centrifugal separator) 100 when viewed from a side thereof. A rotor 1 for receiving a sample to be centrifuged and rotating the sample at high speed is attached to an output shaft of a motor 20. The motor 20 is fixed to a motor base 8, which is a part of a frame, via a damper 11. A rotor chamber 2 is formed around the rotor 1 by a bowl 3 which is made of a material which hardly rusts such as stainless steel or the like, and a cooling pipe 4 is wound around the bowl 3 to cool the rotor chamber 2, thereby preventing a temperature rise due to the rotation of the rotor 1. There is further a heat insulation layer 5 which is made of a foam material or the like around the cooling pipe 4, and a protector 6 is arranged on the outer side of the heat insulation layer 5. In addition, a control unit 19 that controls an operation of the motor 20 is also located in the vicinity of the protector 6. The frame is usually formed by a metal plate or the like, and is formed by a combination of an outer frame 7 at an outer side, a motor base 8, a rear plate 9, a front plate 10, or the like, which are called a frame as a whole. A leg 15 is provided on the bottom surface of the outer frame 7.

A compressor 12, condenser 13 and a fan 14 for performing a cooling operation using the cooling pipe 4 is accommodated at the lower part of the frame (lower side of the motor base 8).

A door packing 16 is provided near the upper opening of the rotor chamber 2, and further, the upper opening is openable and closable by a door 17, through which a sample to be mounted in the rotor 1 can be put or removed. An operation display unit 18 is disposed on the upper surface of the frame.

Figure 2A:
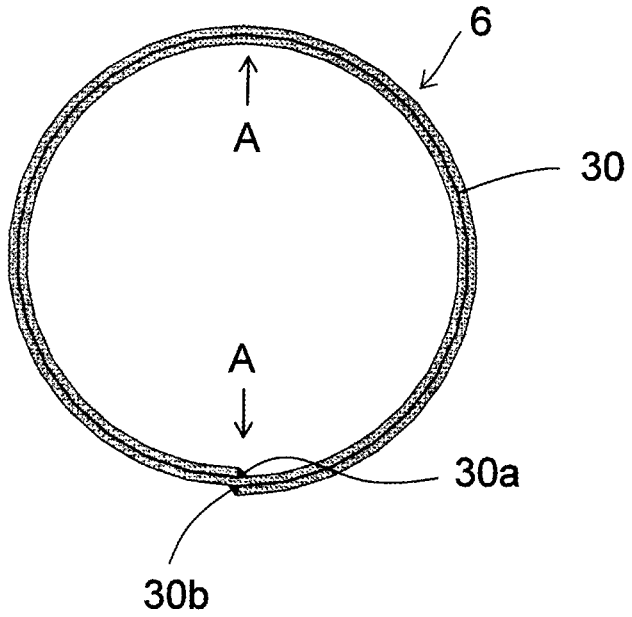
FIG. 2 (2A and 2B) is a cross-sectional plan view of a protector configured by one steel plate according to the first embodiment of the present invention.
Figure 2B:
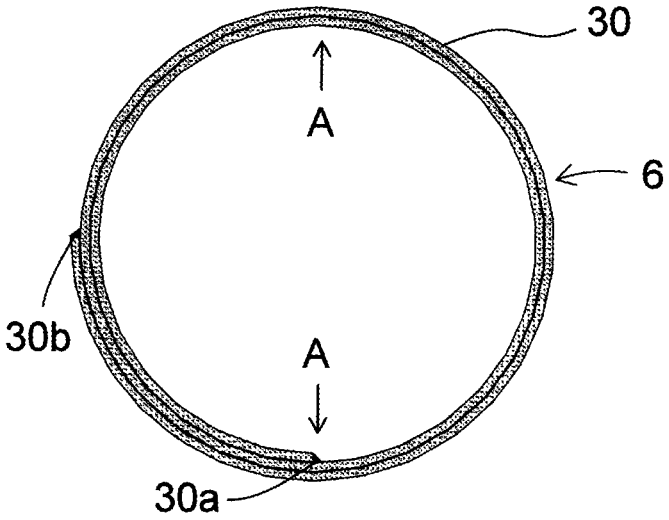

Since the present embodiment is characterized by the configuration of the protector 6, details of the protector 6 will be described below. As described above, if the outer diameter of the rotor chamber 2 is increased, in some cases, a steel pipe having a suitable size may not be available on the market. Therefore, in the present embodiment, a steel pipe is created by winding a steel plate in an arbitrary size and is employed as the protector 6. However, in a case where the steel plate is wound, so much thick steel plate cannot be wound. If the steel plate is wound as a single layer, there is a problem that the thickness of the protector 6 becomes thin and the amount of deformation of the protector 6 increases accordingly when the rotor destructive test is performed. If a gap is to be secured between the protect 6 and the frame in order to meet such a situation, there is a problem that the outer size of the centrifuge is increased as a result thereof. Therefore, in this present embodiment, as shown in FIG. 2A or 2B, one steel plate 30 is wound in an overlapping state so that the steel plate 30 is stacked in two layers or more throughout the entire circumference of the protector 6. The steel plate 30 is welded to maintain the pipe shape by the inner welding portion 30*a* and the outer welding portion 30*b*. Incidentally, the inner welding portion 30*a* and the outer welding portion 30*b* may be formed intermittently or continuously throughout the entire length of the protector 6 in the height direction of the protector 6. The same can be applied even to other embodiments.

Figure 3:
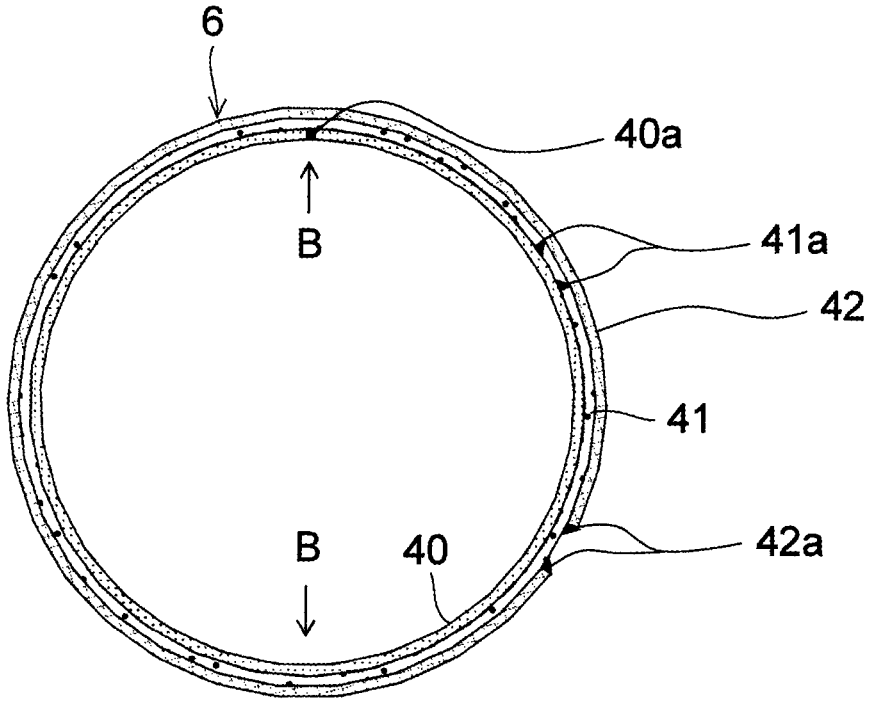
FIG. 3 is a cross-sectional plan view of the protector configured by three steel plates according to a second embodiment of the present invention.

As shown in FIG. 3 of JP 2005-305400 A, since the rotor 1 is broken into two in the routine destructive test of the centrifuge, and the fragments thereof jumps out in a direction of 180 degrees, in the case where the welded points are dispersed, it is preferable to arrange the welding portions in such a manner that the welding portions are avoided from being arranged at a same position in a circumferential direction of the protector and avoided from being arranged so as to face each other in the circumferential direction of the protector. In the example shown in FIG. 2A, in the case where the rotor 1 destructed jumps out in the direction of arrow A, there is a possibility that the welding portion 30*a* and welding portion 30*b* which are overlapped with each other in the circumferential position are broken and the strength thereof is lowered and the deformation thereof increases accordingly. Therefore, in the case where the protector 6 is made by repeatedly winding the steel plate 30 so that the layers thereof are overlapped, as shown in FIG. 2B, it is preferable to arrange the welding portions 30*a*, 30*b* so as to avoid from being arranged at a same position in the circumferential direction and from being arranged so as to face each other in the circumferential direction, so that the welding portions are not overlapped. In the case of FIG. 2B, the welding portions 30*a*, 30*b* are shifted by 90 degrees in the circumferential direction.

According to the present embodiment, it is possible to achieve the following effects.

(1) By forming the protector 6 by repeatedly winding the steel plate 30 in an overlapping state, it becomes possible to obtain the protector 6 having an appropriate size at low cost to match the size of the rotor chamber 2. Accordingly, it is possible to reduce the outer size of the centrifuge and the cost of the centrifuge.

(2) By the configuration in which the steel plate 30 is wound as two or more layers over the entire circumference of the protector 6, it is possible to ensure the desired thickness. Thus, it is possible to reduce the deformation of the protector 6 during the rotor destruction test and it is possible to reduce the gap between the frame and the protector 6 correspondingly, thereby contributing to the miniaturization thereof.

(3) As shown in FIG. 2B, in the case where the welding portions 30*a*, 30*b* of the protector 6 are arranged so as to avoided from being arranged at a same position in the circumferential direction of the protector and avoided from being arranged so as to face each other in the circumferential direction of the protector, it is possible to reduce the damage to the welding portions by collision of the rotor 1, and in this regard, it is possible to reduce the deformation of the protector 6.

Second Embodiment

Figure 4:
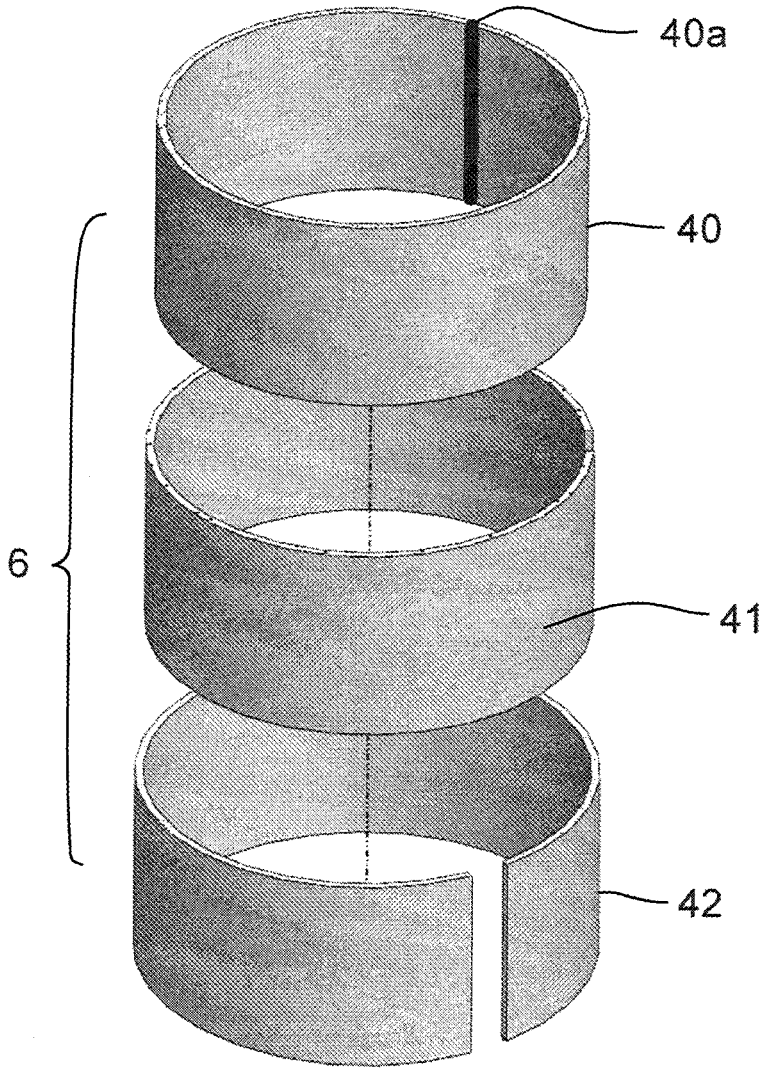
FIG. 4 is an exploded perspective view of the protector shown in FIG. 3.

FIGS. 3 and 4 show the protector 6 according to the second embodiment of the present invention. In this case, the protector 6 is formed by winding three steel plates 40, 41, 42 so as to be overlapped with each other. In the case where a plurality of steel plates are wound so as to be overlapped with each other, the first sheet of the innermost steel plate is welded to be formed in a circular pipe shape, and then, the remaining sheets following the first sheet are wound around the circular shaped steel plate thus formed, and the gapped portion and the inner side steel plate are welded together. At that time, the risk occurring when the welding portions are broken is lowered by allowing the positions of the welding portions to be inconsistent with each other. That is, in the case of FIGS. 3 and 4, the steel plate 40 of the inner side layer is wound in a circular shape and then welded at the welding portion 40*a*, the steel plate 41 of the intermediate layer is wound on the outside thereof so as to be overlapped with each other and welded on the steel plate 40 of the inner layer at the welding portion 41*a*. In addition, the steel plate 42 of the outer side layer is wound on the outer side of the steel plate 41 and welded on the steel plate 41 of the intermediate layer at the welding portion 42*a*, thereby forming a cylindrical steel pipe as a whole.

In the second embodiment, the welded points of the welding portions 40, 41 and 42 are arranged in a dispersed shape. Therefore, for example, even in the case where the rotor destroyed jumps out in the direction B and the welding portion 40*a* disposed in the direction B is destroyed, the strength thereof is maintained by the welding portions 41*a*, 42*a* disposed in the other two directions. As described above, since the rotor 1 is broken into two in the destructive test of the centrifuge and the fragments thereof jump out in the direction of 180 degrees, in the case where the welded points are arranged in a dispersed shape, the welded points are avoided from being arranged at a same position in the circumferential direction and avoided from being arranged so as to face each other in the circumferential direction. In FIG. 3, the welded points are shifted from one another by 60 degrees, and therefore, it is possible to maintain certain strength more than a predetermined strength even when the rotor jumps out in any direction. Further, by overlapping a plurality of steel plates, it is possible to increase the strength thereof.

As such, according to the second embodiment, by winding a plurality of the steel plates in the overlapping state and dispersing the welded points appearing when making the protector with the steel plates, it is possible to keep the average intensity of the protector 6 and reduce the deformation thereof.

Third Embodiment

Figure 5:
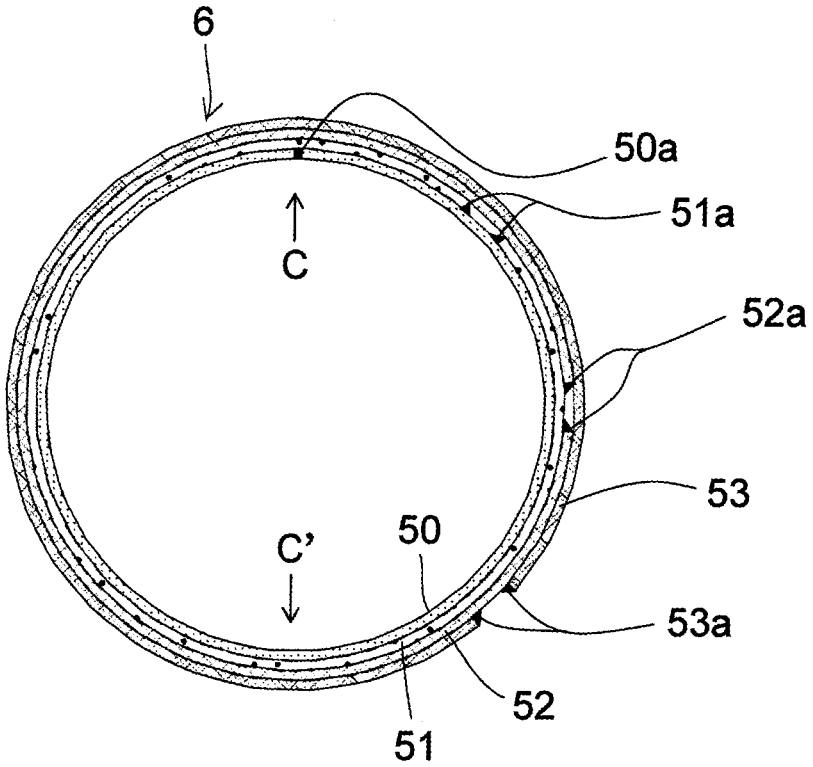
FIG. 5 is a cross-sectional plan view of the protector configured by four steel plates according to a third embodiment of the present invention.

FIG. 5 shows a protector 6 according to the third embodiment of the present invention, which shows the case where four steel plates 50, 51, 52, 53 are wound in an overlapping state. The welding portions 50*a*, 51*a*, 52*a*, 53*a* are arranged at intervals of 45 degrees in the circumferential direction, and thus, the strength above a certain level is maintained regardless of the direction of the destroyed rotor jumping out. At this time, taking into account that the rotor jumps out in a direction of 180 degrees, for example, the welding portion 50*a* disposed in the direction of C may be disposed substantially in the direction of C' facing thereto.

In the case where n steel plates are wound so as to be overlapped with each other as described above, the positions of the welded points are shifted from one another by (180/n) degrees or (180/n+180) degrees and the respective welded points are thereby distributed most averagely with respect to destruction of the rotor.

According to the third embodiment, it is possible to further improve the strength of the protector and thereby reduce the deformation thereof by increasing the number of the steel plates in the overlapping state and arranging the welded points to be shifted.

As in the foregoing, an aspect of the invention has been described in detail with reference to the first to third embodiments thereof. However, it will be appreciated by those skilled in the art that various changes or modifications may be made in each of the components or each of the processes within the scope of claimed inventions. Modification to the first to third embodiments will be described below.

The metal plate for forming the protector 6 is not limited to a steel plate, but iron, iron alloy, aluminum alloy or the like, can also be used depending on the application.

Fourth Embodiment

Figure 6:
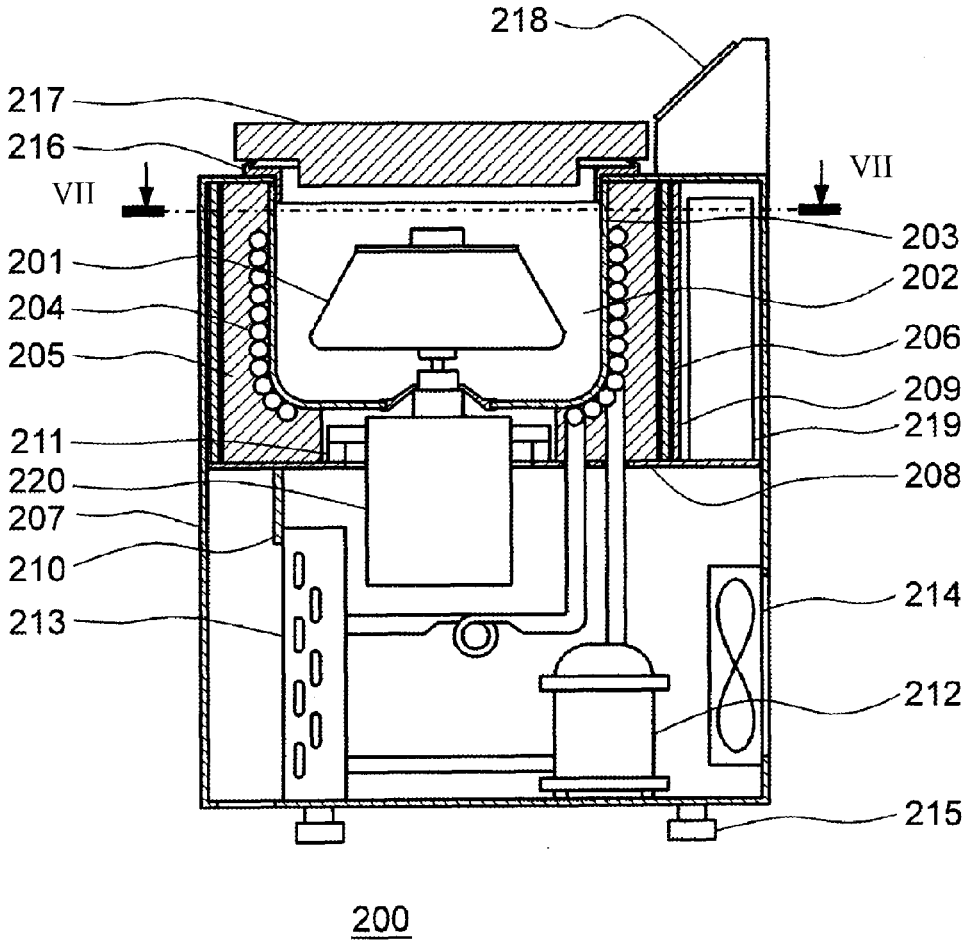
FIG. 6 is a cross-sectional side view of a centrifuge according to a fourth embodiment of the present invention.
Figure 7:
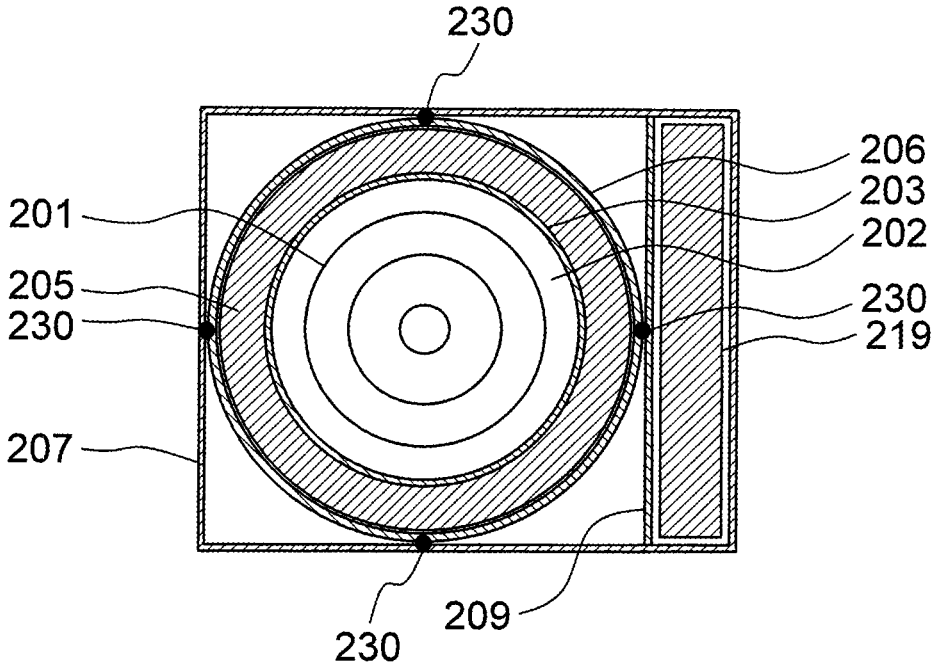
FIG. 7 is a cross-sectional view taken along line VII-VII shown in FIG. 6.

FIG. 6 is a cross-sectional side view of a centrifuge (centrifugal separator) 200 according to a fourth embodiment of the present invention. FIG. 7 is a cross-sectional view taken along line VII-VII shown in FIG. 6. A rotor 201 rotates at high speed while holding a sample container (centrifugal tube or bottle or the like) receiving a sample, not shown, to be centrifuged, and the rotor 201 is attached to an output shaft of a motor 220, the motor 220 being fixed to a motor base 208 which is a part of a frame via a damper 211. A rotor chamber 202 is formed around the rotor 201 by a bowl 203 which is made of a material which hardly rusts such as stainless steel or the like. A door packing 216 attached to a frame is provided near the upper opening of the rotor chamber 202, and further, the upper opening is openable and closable by a door 217, through which a sample to be mounted in the rotor 1 can be put or removed.

A cooling pipe 204 is wound around the bowl 203 to cool the rotor chamber 202 thereby preventing a temperature rise due to the rotation of the rotor 201. There is further a heat insulation layer 205 which is made of a foam material or the like around the cooling pipe 204, and a protector 206 is arranged on the outer side of the heat insulation layer 205. In addition, a control unit 219 that controls an operation of the motor 220 is also located in the vicinity of the protector 206. The frame is usually formed by a metal plate or the like, and is formed as a combination of an outer frame 207 at an outer side, a motor base 208, a rear plate 209, a front plate 210, or the like, which are called a frame as a whole. A leg 215 is provided on the bottom surface of the outer frame 207. A compressor 212, condenser 213 and a fan 214 for performing a cooling operation using the cooling pipe 204 is housed at the lower part of the frame (lower side of the motor base 208). An operation display unit 218 is disposed on the upper surface of the frame.

On the other hand, since the operation of centrifugal separation of the centrifuge or the configuration thereof is well known, additional explanation thereof is omitted. Hereinafter, the safety against the destruction of the rotor 201 will be described according to the embodiment.

As shown in FIG. 7, the protector 206 of a substantially cylindrical shape is surrounded by the outer frame 207 and the rear plate 209 in a rectangular shape (substantially square). The outer peripheral surface of the protector 206, the inner surface of the outer frame 207, and the surface ("frame inner surface", hereinafter) of the protector 206 side of the rear plate 209 are adjacent to each other at a total of four positions as viewed from the upper direction, each of the four positions being joined by welding or the like and indicated as a joint portion 230. The joining of the joint portion 230 may be carried out intermittently or continuously throughout the entire length of the protector 206 in the height direction of the protector 206. The joint portions 230 at the four positions are arranged at approximately 90 degrees intervals around an axis of the rotor 201. The joining at the joint portion 230 may be carried out by screwing or riveting or the like, even without welding.

Figure 8:
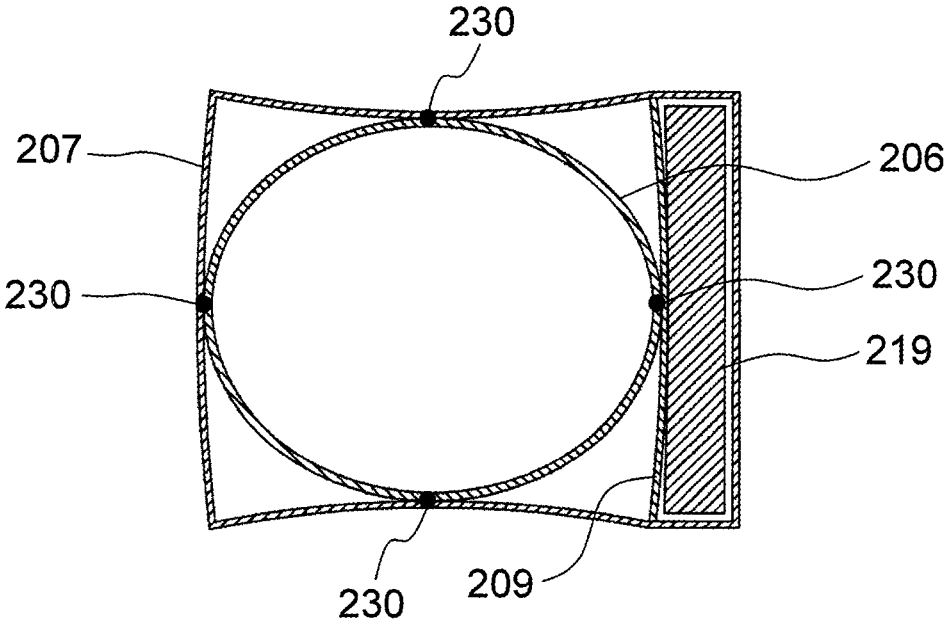
FIG. 8 is an image diagram showing deformation of the centrifuge being broken, which is shown in the same cross-sectional view as in FIG. 7, according to the fourth embodiment of the present invention.
Figure 9:
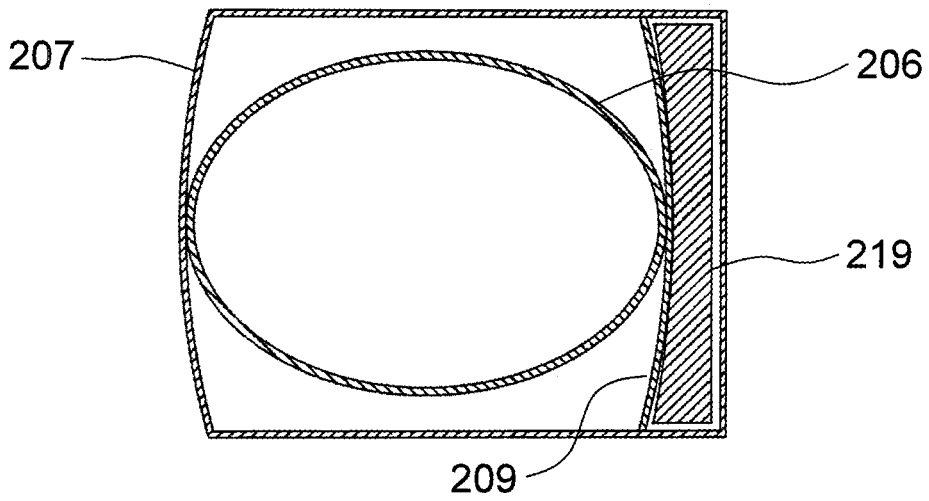
FIG. 9 is an image diagram showing the deformation of the centrifuge (the joining of the joint portions 230 shown in FIG. 7 is omitted) being broken, which is shown in the same cross-sectional view as in FIG. 7, according to a comparative example of the present invention.

FIG. 8 is an image diagram showing the deformation of the broken centrifuge as being shown in the same cross-sectional view as in FIG. 7 according to the embodiment of the present invention. FIG. 9 is an image diagram showing the deformation of the broken centrifuge (the joining of the joint portion 230 shown in FIG. 7 is omitted) as being shown in the same cross-sectional view as in FIG. 7 according to a comparative example of the present invention. However, the rotor 201, the bowl 203, the heat insulation layer 205 and the like are omitted in FIG. 8 and FIG. 9.

The destructive test of the centrifuge is carried out by breaking the rotor 201 into two as shown in FIG. 3, etc. of JP 2005-305400 A. In the destructive test of the centrifuge, the fragments of the rotor 1 broken into two jumps out in the opposite directions of 180 degrees, respectively. Accordingly, FIGS. 8 and 9 are image diagrams showing the deformation of the frame such as the protector 206, the outer frame 207 and the rear plate 209 when the rotor 201 jumps out in the horizontal direction in the drawing.

Since a commercial steel pipe cannot be used because there is no steel pipe having a required size as a protector, if a metal plate such as a steel plate is employed as a protector by being wound, the protector 206 inevitably becomes thin. Therefore, in the configuration of the comparative example shown in FIG. 9, since only the protector 206 receives the power of destruction of the rotor 201, the amount of the deformation (expansion in the horizontal direction) of the protector 206 becomes large, and thus, the frame is deformed only in one direction, thereby resulting in damage even to the control unit 219 or the like. This causes an insulation withstand voltage failure thereof after the destructive test. Further, in the configuration of the comparative example of FIG. 9, since the protector 206 is not fixed to the frame, the protector 206 having been largely deformed is rotated within the frame. At this time, there is a possibility that the components in the frame are destroyed, whereby it increases the possibility that the test cannot be cleared. In contrast, in the configuration of the embodiment shown in FIG. 8, the destructive power can be shared so that the frame can also receive the force (deformation of the protector 206) of destroying the rotor 201. That is, in the configuration of the embodiment shown in FIG. 8, since a part of the force to expand the protector 206 in the horizontal direction is absorbed by both sides of the outer frame 207 being concavely curved along the vertical direction of the figure, it is possible to suppress the deformation of the protector 206 (expansion in a horizontal direction) as compared with the configuration of the comparative example shown in FIG. 9, whereby it is possible to reduce the damage to the peripheral members (control unit 219 or the like) of the protector 206, and further, it is possible to reduce the possibility that the test cannot be cleared.

According to the fourth embodiment, it is possible to achieve the following effects.

(1) By the new configuration in which the protector 206 and the frame are joined and accordingly the power due to the destruction of the rotor 201 is absorbed actively by the frame as well as the protector 206, it is possible suppress the deformation of the protector 206, whereby it is possible to reduce the damage to the peripheral members (control unit 219 or the like) of the protector 206.

(2) Since the protector 206 and the frame are joined at the four positions of the joint portions 230, it is possible to suppress the deformation of the protector 206 by the frame even when the broken rotor 201 flies in any direction.

(3) Since the safety against the destruction of the rotor 201 can be ensured even by a thin protector 206 formed by winding the metal plate such as a steel plate, even if a steel pipe of an appropriate size is not available, it is possible to provide the protector 206 so as to surround the periphery of the heat insulation layer in the vicinity thereof, whereby it is advantageous for the downsizing as a user's needs.

(4) Since the outer peripheral surface of the protector 206 and the inner surface of the frame are in contact with each other, as compared with a related-art configuration to ensure a space in order for the deformed protector not to be in contact with the frame, it is advantageous for the downsizing as a user's needs.

In the foregoing, the present invention has been described with reference to the fourth embodiment, but it will be appreciated by those skilled in the art that various changes may be made in the each element or each process of the embodiments without departing from the principles and spirit of the invention, the scope of which is defined in the appended claims and their equivalents. Hereinafter, the changes will be described as an example.

The joint portions 230 between the protector 206 and the frame may be formed at positions less than four positions. It is preferable to provide the joint portions 230 at four positions or more as in the embodiments in consideration of the magnitude of the absorbed destructive force by the frame or the destructive force can effectively be absorbed by the frame at all directions. If the joint portions 230 exist even at one position, however, it is possible to increase the safety against the destruction of the rotor 201 as compared with the configuration of the comparative example shown in FIG. 9.

Figure 10:
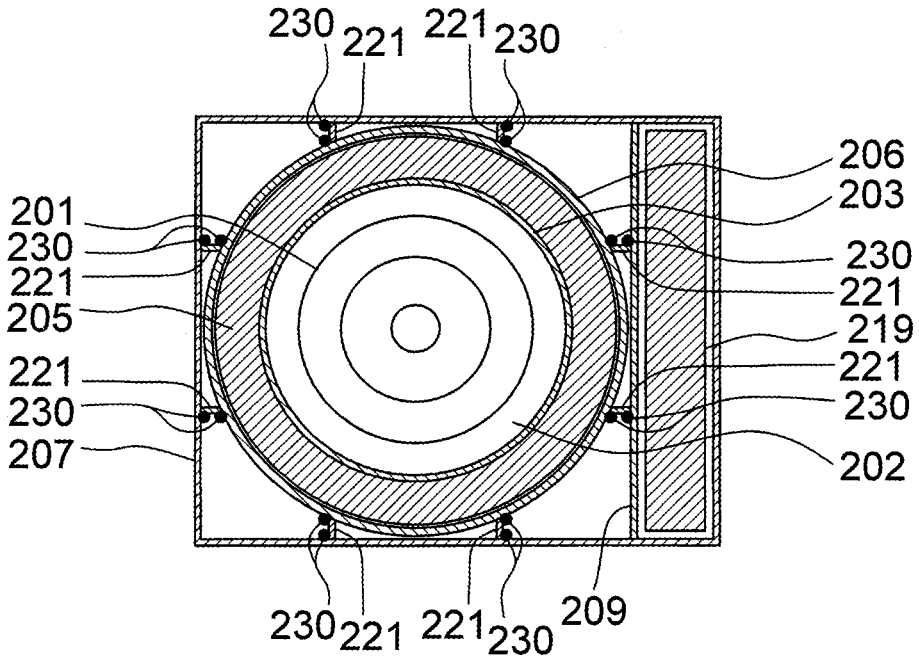
FIG. 10 is a cross-sectional view of the centrifuge, which is shown in the same cross-sectional view as in FIG. 7, according to another embodiment of the present invention.

The protector 206 and the frame need not necessarily be in direct contact with each other. Further, the protector 206 and the frame may be joined indirectly with a joint member 221 (plate) inserted between the frame and the protector 206, as shown in FIG. 10. That is, it is only necessary to finally support the deformation of the broken protector 206 broken, as shown in FIG. 8, also by the frame.

Even in the centrifuge in which the cooling pipe 204 is not wound on the bowl 203, the techniques according to the present embodiment in which the protector 206 and the frame are joined together are effective. Further, even in a case where a steel pipe commercially available is used as the protector 206, the techniques according to the present embodiment are likewise effective.

The present invention provides illustrative, non-limiting aspects as follows:

(1) In a first aspect, there is provided a centrifuge including: a rotor configured to be rotatably driven; a rotor chamber accommodating the rotor therein; and a protector provided at an outer periphery of the rotor chamber, wherein the protector includes at least one metal plate which is wound in an overlapping state.

(2) In a second aspect, there is provided the centrifuge according to the first aspect, wherein the at least one metal plate is wound as two or more layers over an entire circumference of the protector.

(3) In a third aspect, there is provided the centrifuge according to the first aspect or the second aspect, wherein the at least one metal plate is welded at welding portions which are avoided from being arranged at a same position in a circumferential direction of the protector and avoided from being arranged so as to face each other in the circumferential direction of the protector.

(4) In a fourth aspect, there is provided the centrifuge according to the first or second aspect, wherein n metal plates are wound in the overlapping state, and wherein welding portions of the metal plates are arranged by being shifted by (180/n) degrees or (180/n+180) degrees from one another.

(5) In a fifth aspect, there is provided a centrifuge including: a rotor configured to be rotatably driven; a rotor chamber accommodating the rotor therein; a protector provided at an outer periphery of the rotor chamber; and a frame surrounding at least an outer periphery of the protector, wherein the protector and the frame are joined to each other at at least one position.

(6) In a sixth aspect, there is provided the centrifuge according to the fifth aspect, wherein the protector and the frame are joined to each other at at least four positions, and the joined portions at the four positions are arranged at intervals of 90 degrees around an axis of the rotor.

(7) In a seventh aspect, there is provided the centrifuge according to the fifth or sixth aspect, wherein the protector has an approximately cylindrical shape, and wherein the frame surrounds an outer periphery of the protector in a rectangular shape.

(8) In an eighth aspect, there is provided the centrifuge according to any one of the fifth to seventh aspect, wherein a control unit is disposed at an outer side of the protector, and wherein the frame includes a plate spacing the control unit and the protector from each other.

(9) In a ninth aspect, there is provided the centrifuge according to any one of the fifth to eighth aspects, wherein a cooling pipe is wound around the rotor, wherein a heat insulation layer is provided around the cooling pipe, and wherein the protector surrounds an outer periphery of the heat insulation layer so as to be adjacent to the heat insulation layer.

Meanwhile, any combination of the components described above, and transformation of the present invention into methods or systems are also effective as aspects of the present invention.

The invention claimed is:

1. A centrifuge comprising:

a rotor configured to be rotatably driven;

a rotor chamber accommodating the rotor therein; and a protector provided at an outer periphery of the rotor chamber, wherein the protector includes at least one metal plate which is wound in an overlapping state, and wherein the at least one metal plate is welded at welding portions which are avoided from being arranged at a same position in a circumferential direction of the protector and avoided from being arranged so as to face each other in the circumferential direction of the protector.

2. The centrifuge according to claim 1, wherein the at least one metal plate is wound as two or more layers over an entire circumference of the protector.

3. The centrifuge according to claim 1, wherein n metal plates are wound in the overlapping state, and wherein welding portions of the metal plates are arranged by being shifted by (180/n) degrees or (180/n+180) degrees from one another.

4. A centrifuge comprising:

a rotor configured to be rotatably driven;

a rotor chamber accommodating the rotor therein;

a protector provided at an outer periphery of the rotor chamber; and a frame surrounding at least an outer periphery of the protector, wherein the protector and the frame are joined to each other at at least one position, and wherein the protector and the frame are jointed to each other intermittently or continuously throughout an entire length of the protector in a height direction of the protector.

5. The centrifuge according to claim 4, wherein the protector and the frame are joined to each other at at least four positions, and the joined portions at the four positions are arranged at intervals of 90 degrees around an axis of the rotor.

6. The centrifuge according to claim 4, wherein the protector has an approximately cylindrical shape, and wherein the frame surrounds the outer periphery of the protector in a rectangular shape.

7. The centrifuge according to claim 4, wherein a control unit is disposed at an outer side of the protector, and wherein the frame includes a plate spacing the control unit and the protector from each other.

8. The centrifuge according to claim 4, wherein a cooling pipe is wound around the rotor, wherein a heat insulation layer is provided around the cooling pipe, and wherein the protector surrounds an outer periphery of the heat insulation layer so as to be adjacent to the heat insulation layer.

* * * * *